US008661848B2

(12) United States Patent
Bisserier

(10) Patent No.: US 8,661,848 B2
(45) Date of Patent: Mar. 4, 2014

(54) CONCENTRIC ROTATABLE RINGS

(76) Inventor: Claude Bisserier, Oak Park, CA (US)

( * ) Notice: Subject to any disclaimer, the term of this patent is extended or adjusted under 35 U.S.C. 154(b) by 0 days.

(21) Appl. No.: 13/448,708

(22) Filed: Apr. 17, 2012

(65) Prior Publication Data

US 2012/0198887 A1 Aug. 9, 2012

Related U.S. Application Data

(63) Continuation of application No. PCT/US2010/060550, filed on Dec. 15, 2010.

(60) Provisional application No. 61/288,162, filed on Dec. 18, 2009, provisional application No. 61/345,484, filed on May 17, 2010.

(51) Int. Cl.
*A44C 9/00* (2006.01)

(52) U.S. Cl.
USPC ..... 63/15.1; 63/15; D11/26

(58) Field of Classification Search
None
See application file for complete search history.

(56) References Cited

U.S. PATENT DOCUMENTS

| | | | | | |
|---|---|---|---|---|---|
| 76,470 | A | * | 4/1868 | Kinsel | 63/41 |
| 211,558 | A | * | 1/1879 | Edwards | 63/15 |
| 1,596,642 | A | * | 8/1926 | Weber | 63/15.4 |
| 1,830,929 | A | * | 11/1931 | Cohen | 63/15 |
| 1,936,604 | A | * | 11/1933 | Moldenhauer | 63/15 |
| 2,048,878 | A | * | 7/1936 | Moldenhauer | 63/15 |
| 2,073,280 | A | * | 3/1937 | Lederer | 40/633 |
| 2,493,285 | A | * | 1/1950 | Granat | 63/15.2 |
| 2,706,542 | A | * | 4/1955 | Schaeffer | 403/14 |
| 2,726,520 | A | * | 12/1955 | Debler | 63/15.3 |
| 3,307,375 | A | * | 3/1967 | Estrin et al. | 63/15 |
| 3,543,535 | A | * | 12/1970 | Siegel et al. | 63/29.1 |
| 5,228,316 | A | * | 7/1993 | Meyrowitz | 63/15.4 |
| 5,228,317 | A | * | 7/1993 | Hendricks | 63/15.7 |
| 5,253,490 | A | * | 10/1993 | Doganay | 63/15.4 |
| 5,353,608 | A | * | 10/1994 | Berkowitz | 63/33 |
| 5,375,434 | A | * | 12/1994 | Wertheimer et al. | 63/29.1 |
| 5,419,158 | A | * | 5/1995 | Sandberg et al. | 63/15.4 |
| 5,669,241 | A | * | 9/1997 | Kohl | 63/15.2 |
| D420,932 | S | * | 2/2000 | Shinohara | D11/26 |
| 6,186,552 | B1 | * | 2/2001 | Seabrook | 281/45 |
| 6,209,351 | B1 | | 4/2001 | Zeleny | |
| 6,318,122 | B1 | * | 11/2001 | Burgard | 63/29.1 |
| D462,028 | S | * | 8/2002 | Roure | D11/26 |
| 7,296,439 | B2 | * | 11/2007 | Tanory, Jr. | 63/15 |

(Continued)

FOREIGN PATENT DOCUMENTS

WO WO2008/134558 11/2008

OTHER PUBLICATIONS

International Search Report for Serial No. PCT/US2010/60550 mailed Jan. 9 2011.

*Primary Examiner* — Jack W. Lavinder
(74) *Attorney, Agent, or Firm* — Brooks Acordia IP Law, P.C.; Pejman Yedidsion; Christopher Weiss

(57) ABSTRACT

Articles of jewelry, including ring assemblies (100, 300, 400, 700, 1300) permitting secured, removable, rotatable, placement of rings within such ring assemblies (100, 300, 400, 700, 1300). In some embodiments, an ornamental support structure (412, 712, 715, 1312) comprises a hinge permitting a rotatable movement of a portion of the ring assembly to permit placement of the ring structure. In other embodiments, pinch clasps (520, 620, 820, 920, 1020, 1120, 1220, 1320) are used for such ring assemblies.

15 Claims, 13 Drawing Sheets

(56) References Cited

U.S. PATENT DOCUMENTS

| | | | | |
|---|---|---|---|---|
| 7,398,657 | B2 * | 7/2008 | Cleofas | 63/15 |
| 7,614,252 | B2 * | 11/2009 | De Lyrot | 63/15.1 |
| 7,950,251 | B2 * | 5/2011 | Silvant | 63/15.2 |
| 8,316,666 | B2 * | 11/2012 | Patterson | 63/15.4 |
| 2006/0218969 | A1 * | 10/2006 | Cleofas | 63/15.4 |
| 2011/0179823 | A1 * | 7/2011 | Moody | 63/4 |

* cited by examiner

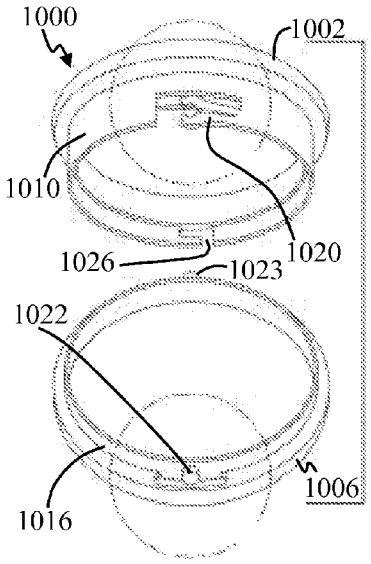
FIG. 10A
FIG. 10B
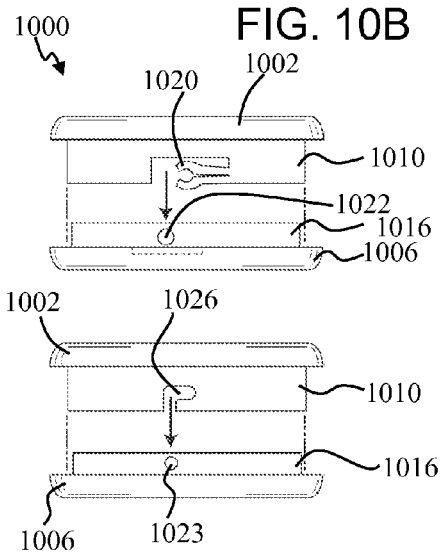
FIG. 10C
FIG. 10D
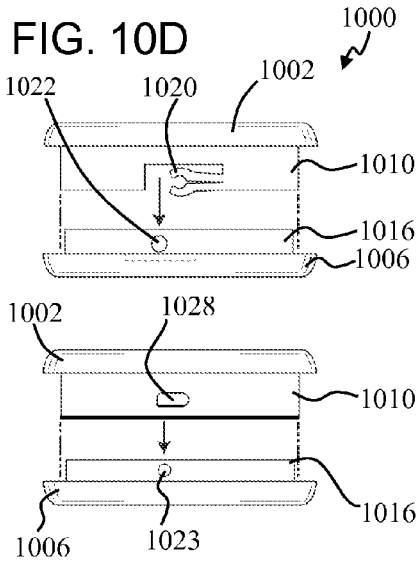
FIG. 10E
FIG. 10F
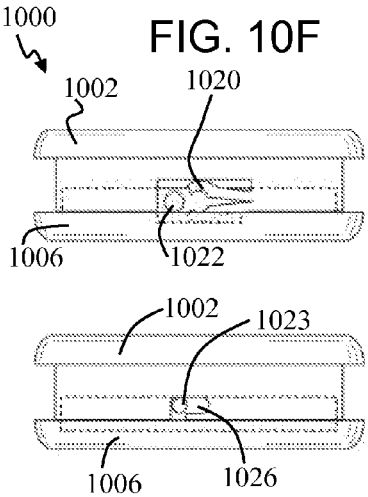
FIG. 10G

CONCENTRIC ROTATABLE RINGS

CROSS-REFERENCE TO RELATED APPLICATIONS

This application is a continuation of International Application No. PCT/US2010/060550 filed Dec. 15, 2010, which claims priority to and the benefit of U.S. Provisional Patent Application Ser. No. 61/288,162, filed Dec. 18, 2009, and Ser. No. 61/345,484, filed May 17, 2010, the disclosures of all of which are hereby incorporated by reference in their entirety, inclusive of the appendix of Ser. No. 61/288,162.

TECHNICAL FIELD

Embodiments pertain to jewelry ring assemblies and particularly to mounting ornaments via a ring assembly element retaining a rotatable ring.

BACKGROUND

U.S. Pat. No. 6,497,117 to Ofiesh, II, discloses a base ring having an annular channel retaining a rotatable ring. U.S. Pat. No. 5,161,392 to Wiriath et al. discloses circular pieces of jewelry having a rotating outer band. U.S. Pat. No. 6,101,843 to Nagano discloses an outer ring having ornaments and magnets rotatably engaging an inner ring having magnets. U.S. Pat. No. 5,678,428 to Pasquetti discloses an annular piece of jewelry particularly a ring or a bracelet having an outer rotary crown.

DISCLOSURE

Exemplary embodiments may include an article of jewelry comprising: (a) a first annular element having an inner diameter defining an aperture, the first annular element comprising an annular peripheral channel comprising a base having an outer diameter, the base, having a width, interposed between a first peripheral portion and a rotably attached second peripheral portion, e.g., via a hinge joint; and (b) a second annular element, e.g., an insertable annular element, having an inner diameter, an outer diameter, and an axial width smaller than the width of the annular peripheral base, the second annular element laterally retained by the peripheral channel and disposed coaxially about, and substantially coplanar with, the first element; (c) where the first annular element further comprises an ornament support structure comprising: (1) a first ornament support structural element attached to at least one of: a portion of a first peripheral rim and a portion of the first peripheral portion of the first element, and extending in a substantially radial direction beyond the outer diameter of the second annular element and (2) a second ornament support structural element attached to at least one of: a portion of a second peripheral rim and a portion of the second peripheral portion of the first element proximate to the attached second ornamental support structural element, and extending in a substantially radial direction beyond the outer diameter of the second annular element, wherein the second annular element is interposed between the first ornament support structural element and the second ornament support structural element.

Additional exemplary embodiments may include an article of jewelry comprising a hinge having an ornament structure with a first annular element having an inner diameter defining an aperture, comprising an annular peripheral channel comprising a base having an outer diameter, the base, having a width, interposed between a first peripheral portion and a rotatably attached second peripheral portion; and a second annular element, having an inner diameter, an outer diameter, and an axial width smaller than the width of the annular peripheral base, the second annular element laterally retained by the peripheral channel and disposed coaxially about, and substantially coplanar with, the first element; where the first annular element further comprises an ornament support structure that comprises a first ornament support structural element attached to at least one of: a portion of a first peripheral rim and a portion of the first peripheral portion of the first element, and extending in a substantially radial direction beyond the outer diameter of the second annular element and a second ornament support structural element attached to at least one of: a portion of a second peripheral rim and a portion of the second peripheral portion of the first element proximate to the attached second ornamental support structural element, and extending in a substantially radial direction beyond the outer diameter of the second annular element, where the second annular element is interposed between the first ornament support structural element and the second ornament support structural element.

Exemplary embodiments may include an article of jewelry comprising a hinge with an ornament structure and a perpendicular clasp with a first annular element having an inner diameter defining an aperture, the first annular element comprising an annular peripheral channel comprising a base having an outer diameter, the base, having a width, interposed between a first peripheral portion and a rotatably attached second peripheral portion; and a second annular element, having an inner diameter, an outer diameter, and an axial width smaller than the width of the annular peripheral base, the second annular element laterally retained by the peripheral channel and disposed coaxially about, and substantially coplanar with, the first element; where the first annular element further comprises an ornament support structure that comprises a first ornament support structural element attached to at least one of: a portion of a first peripheral rim and a portion of the first peripheral portion of the first element, and extending in a substantially radial direction beyond the outer diameter of the second annular element and a second ornament support structural element attached to at least one of: a portion of a second peripheral rim and a portion of the second peripheral portion of the first element, proximate to the attached second ornamental support structural element, and extending in a substantially radial direction beyond the outer diameter of the second annular element, where the second annular element is interposed between the first ornament support structural element and the second ornament support structural element; where the annular peripheral base comprises a perpendicular pinch clasp extending in a radial direction from the first peripheral portion to the second peripheral portion, in substantially the same length as the width of the base, interposed between the first peripheral portion and the annular peripheral channel's outer diameter; where the second peripheral portion comprises a pin inside a depression, aligned with the pinch clasp.

An article of jewelry comprising a no hinge, no ornament, tangential clasp with an annular element having an inner diameter defining an aperture, a first peripheral portion and a second peripheral portion, the first peripheral portion which comprises an annular peripheral channel comprising a base having an outer diameter, the base, having a width, interposed between the first peripheral portion and a second peripheral portion; and the second peripheral portion comprising an inner diameter, an outer diameter, and an axial width smaller than the width of the annular peripheral base, the second peripheral portion laterally retained by the peripheral channel and disposed coaxially about, and substantially coplanar with, the first peripheral portion; where the first and second peripheral portions are comprised of a pinch clasp and a pin; where the base of the annular peripheral channel comprises a perpendicular pinch clasp extending in a radial direction from the first peripheral portion to the second peripheral portion, in substantially the same length as the width of the base, interposed between the first peripheral portion and the annular peripheral channel's outer diameter; and where the second peripheral portion comprises a pin inside a depression, aligned with the pinch clasp.

BRIEF DESCRIPTION OF THE DRAWINGS

Embodiments of the present invention are illustrated by way of example and not limitation in the figures of the accompanying drawings, and in which:

FIG. 10A is an exploded perspective view showing an exemplary pinch slot mechanism of a third embodiment of an annular element assembly;

FIG. 10B is a front-side elevation view, open with pinch clasp in relaxed state of a third embodiment of an annular element assembly;

FIG. 10C is a back-side elevation view, open with pinch clasp in relaxed state of a third embodiment of an annular element assembly;

FIG. 10D is a front-side elevation view, open with pinch clasp in a relaxed state of an alternate third embodiment of FIG. 10B;

FIG. 10E is a back-side elevation view, open with pinch clasp in a relaxed state of an alternate third embodiment of FIG. 10C;

FIG. 10F is a front-side elevation view closed with pin and clasp in relaxed state, of a third embodiment of a ring assembly;

FIG. 10G is a back-side elevation view closed with pin and clasp in relaxed state, of a third embodiment of a ring assembly;

BEST MODES

Figure 1B:
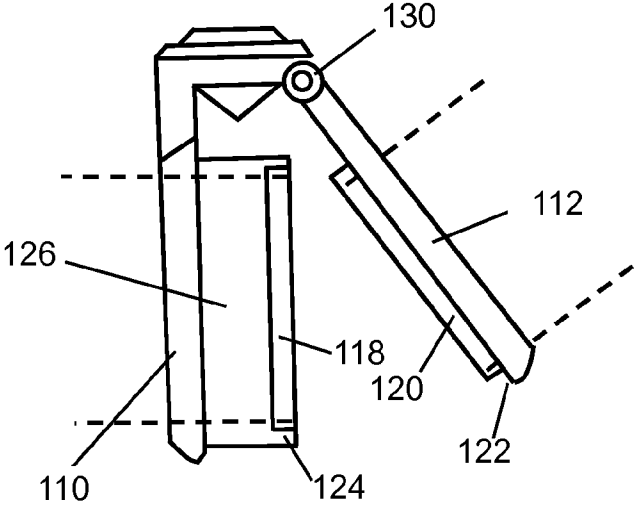
FIG. 1B is a side view of an exemplary embodiment.
Figure 1A:
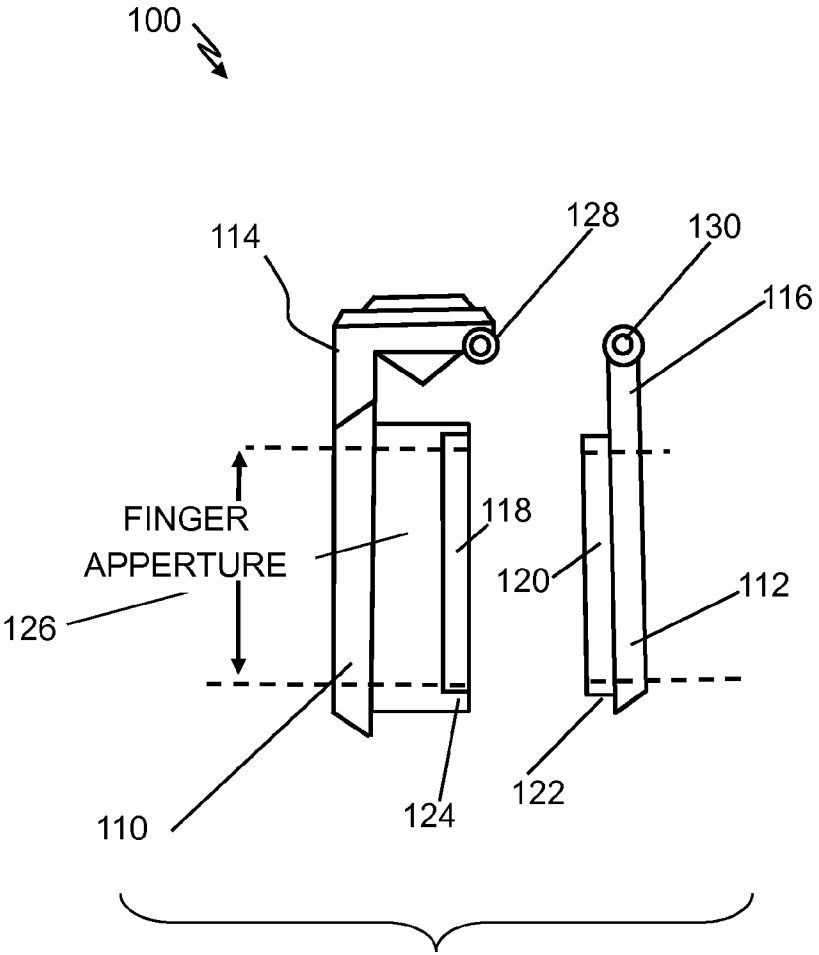
FIG. 1A is an exploded side view of an exemplary embodiment.

FIG. 1A depicts an exploded side view of an exemplary embodiment 100 and FIG. 1B depicts, in a side view, the articulated exemplary embodiment. The first hinged ring portion 110 is depicted as configured to be hinged at a first joint portion 128 to second hinged annular element portion 112 at second joint portion 130. The first hinged annular element portion 110 is depicted has having an inner annular element portion 126 having a socket portion 118 into which a flanged portion 120 of the second hinged annular element may be engaged. A second annular element (not shown) having an inner diameter larger than the outer diameter of the inner annular portion 126 may be disposed about the inner ring portion 126 prior to engaging the flanged portion 120 into the socket portion 118. Once the flanged portion 120 is engaged in the socket portion 118, the second annular element is constrained by the raised sides of both the first hinged annular element portion 110 and the second hinged annular element portion 112. The second joint portion 130 may be disposed at the distal end of the second ornament support member 116. The first joint portion 128 may be disposed on the cross support member extending from the first support member 114. FIG. 1B depicts a first hinged annular element portion 110 and a second hinged annular element portion 112 rotatably connected at the hinged joint, 130. The outer diameter of the flange 120 is less than the inner diameter of the socket 118 and the length of extension of the flange 122 is the same or about the same as the depth of the socket 124. The length of extension of the flange 122 may be sized to be smaller than the width of the hinged annular element assembly in order that the flange 120 may clear the outer lip of the socket 118 and yet provide a securing contact with the inner surface of the socket 118.

Figure 2B:
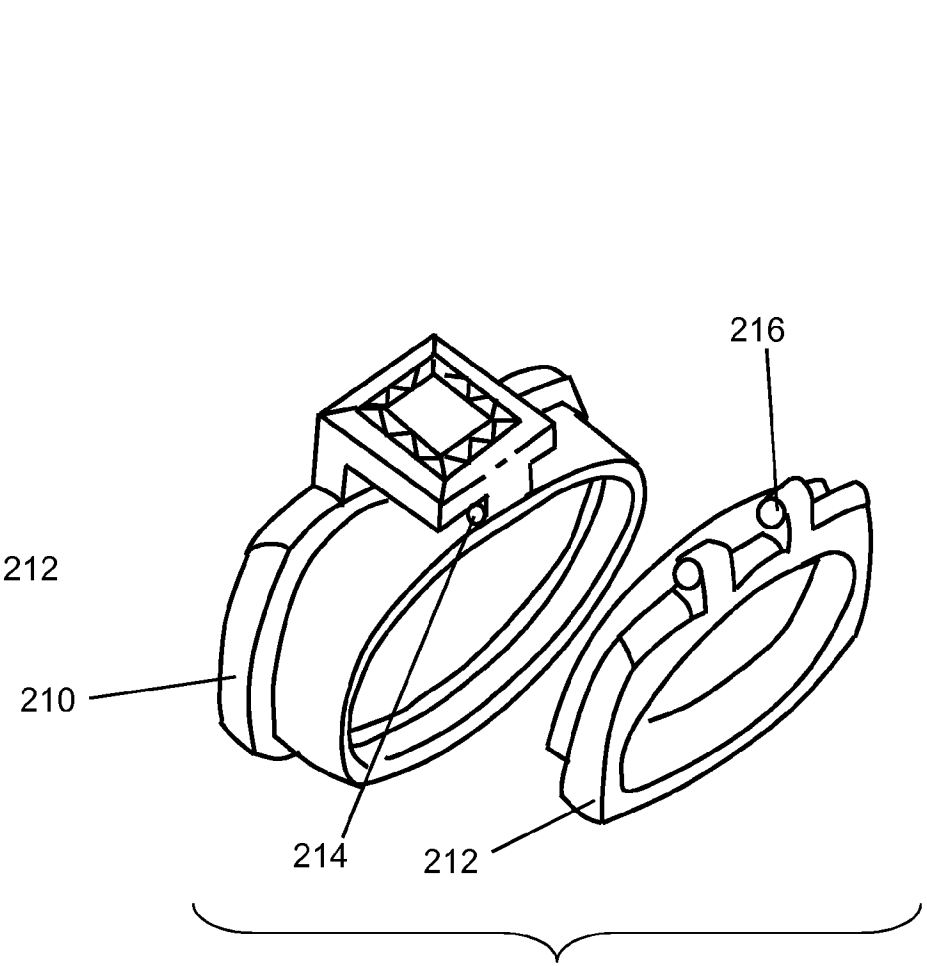
FIG. 2B is an exploded perspective view of an exemplary embodiment of FIG. 2A.
Figure 2A:
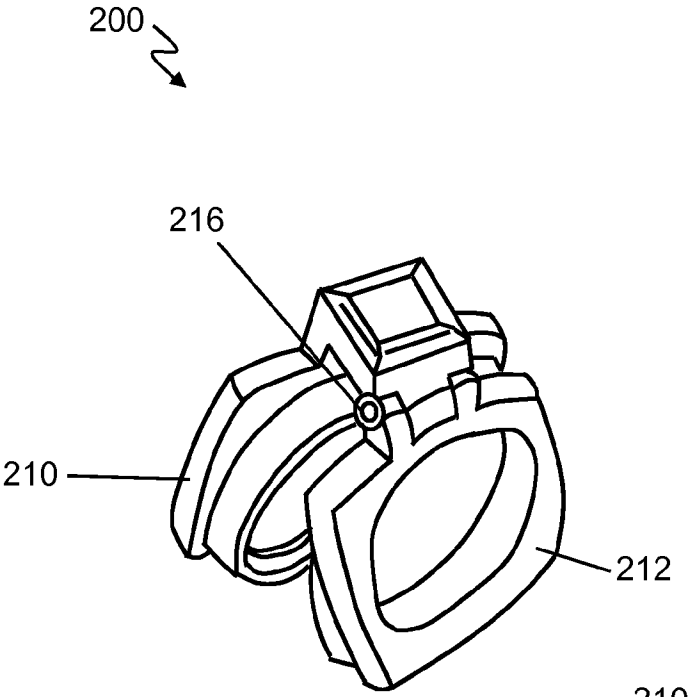
FIG. 2A is a perspective view of an exemplary embodiment.

FIG. 2A is a perspective view of an exemplary embodiment 200 depicting the first hinged annular element portion 210 and the second hinged annular element portion 212 rotatably connected at the hinged joint 216. FIG. 2B is an exploded perspective view of an exemplary embodiment of FIG. 2A, showing the hinged joint 214 of the first hinged annular element.

Figure 3A:
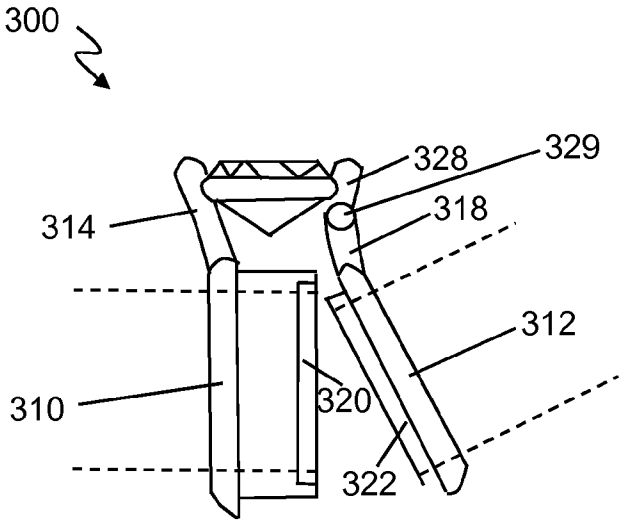
FIG. 3A is a side view of an exemplary embodiment.

FIG. 3A is a side view of an exemplary embodiment 300 depicting an ornamental support structure comprising a fixed portion 314, an upper portion 328, and a lower portion 318 attached via a hinged joint 329. It is about this hinge joint 329, that a second hinged annular element portion 312 having a flange 322 may rotate, to engage the socket 320.

Figure 3B:
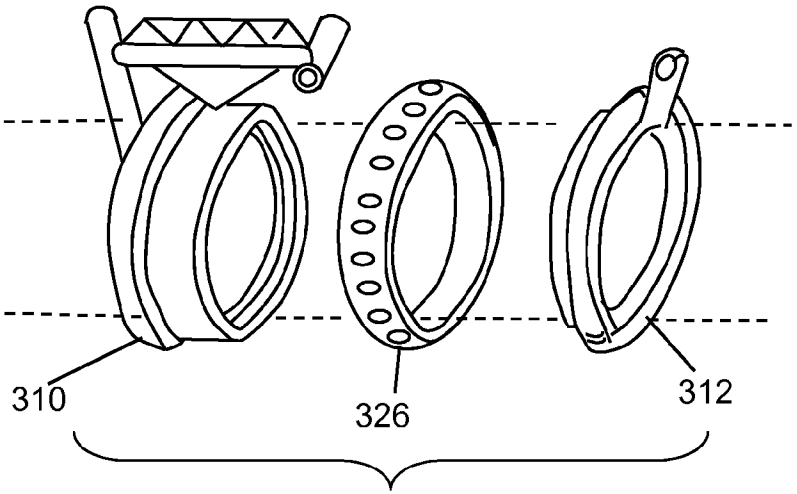
FIG. 3B is an exploded perspective view of an exemplary embodiment.

FIG. 3B is an exploded perspective view of an exemplary embodiment 300 of FIG. 3A depicting a removable annular element 326, A second annular element, or freely rotatable second annular element, may be disposed between the first annular element 310 and the rotatably attached second peripheral portion 312.

Figure 3C:
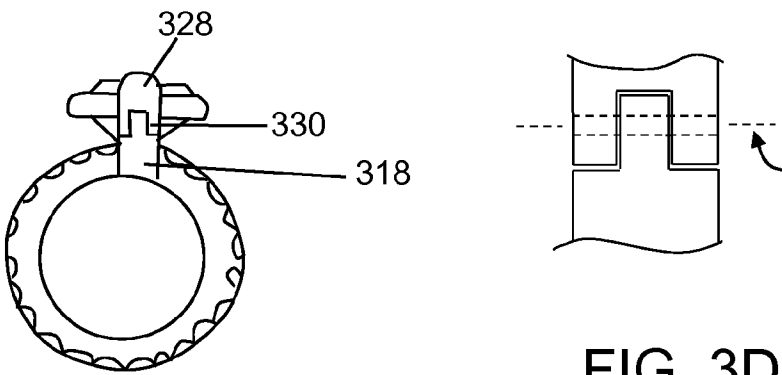
FIG. 3C is a front view of an exemplary embodiment.
Figure 3D:
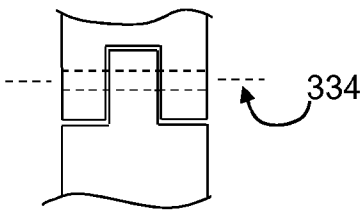
FIG. 3D depicts an exemplary hinge line of an exemplary embodiment.

FIG. 3C is a front view of exemplary embodiment 300, depicting an exemplary hinge line 330 of the exemplary embodiment of FIG. 3A. FIG. 3D depicts an exemplary hinge line, the pin 334 is shown in dashed lines of the exemplary embodiment of the present invention of FIG. 3A.

Figure 4A:
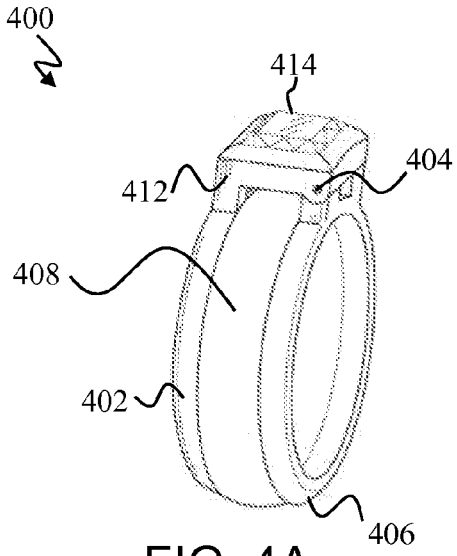
FIG. 4A is a closed perspective view of an exemplary embodiment of an annular element assembly.

FIG. 4A is a closed perspective view of an exemplary embodiment of an annular element assembly 400. The exemplary annular element assembly 400 comprises an annular first peripheral portion 402, a support structure 412, an ornament, e.g., a stone 414, a second hinged peripheral portion 406, and a hinge joint 404. The first peripheral portion 402 is depicted as having a support structure 412, where the second peripheral portion 406 is rotatably connected to a support structure 412, via a hinge joint 404.

Figure 4B:
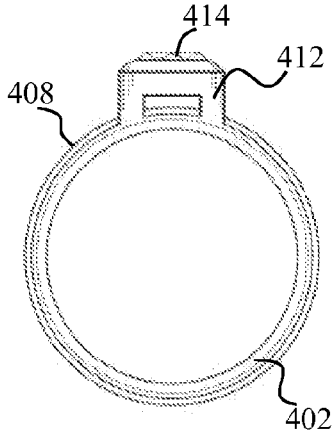
FIG. 4B is a front view of an exemplary embodiment of an annular element assembly.

FIG. 4B is a front view of an exemplary embodiment of a ring assembly 400. In this embodiment a first peripheral portion 402, is shown with a freely rotatable second annular element 408.

Figure 4C:
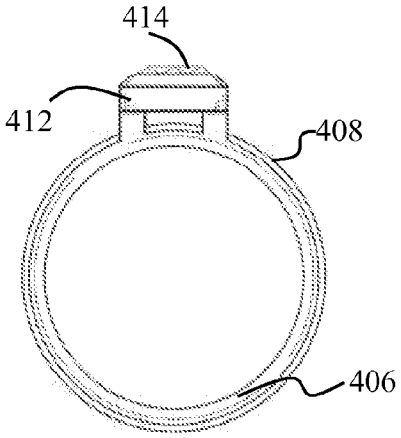
FIG. 4C is a back view of an exemplary embodiment of an annular element assembly.

FIG. 4C is a back view of an exemplary embodiment of a ring assembly 400.

Figure 4D:
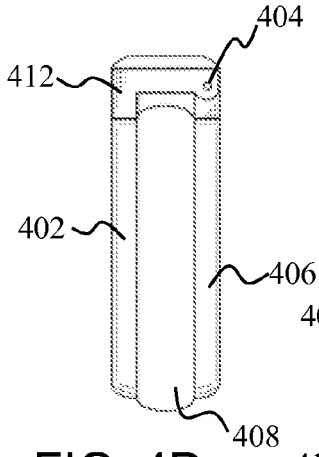
FIG. 4D is a side view of an exemplary embodiment of an annular element assembly.

FIG. 4D is a side view of an exemplary embodiment of a ring assembly 400. The first peripheral portion 402 is depicted as configured to be hinged at a first joint portion 404 to a second hinged peripheral portion 406. The first peripheral portion 402 is depicted has having an annular element 408 having an inner diameter larger than the outer diameter of the base of a peripheral channel 410 (see FIG. 5A).

Figure 4E:
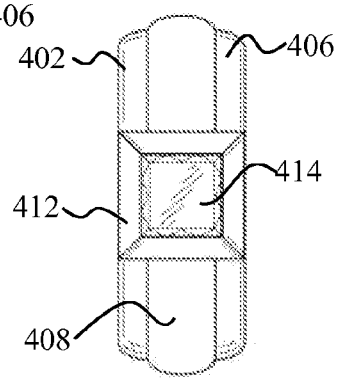
FIG. 4E is a top view of an exemplary embodiment of an annular element assembly.

FIG. 4E shows a top view of an exemplary embodiment having a three-dimensional (e.g., a square-shaped and legged) support structure 412 for the ornament 414 in this example.

Figure 5A:
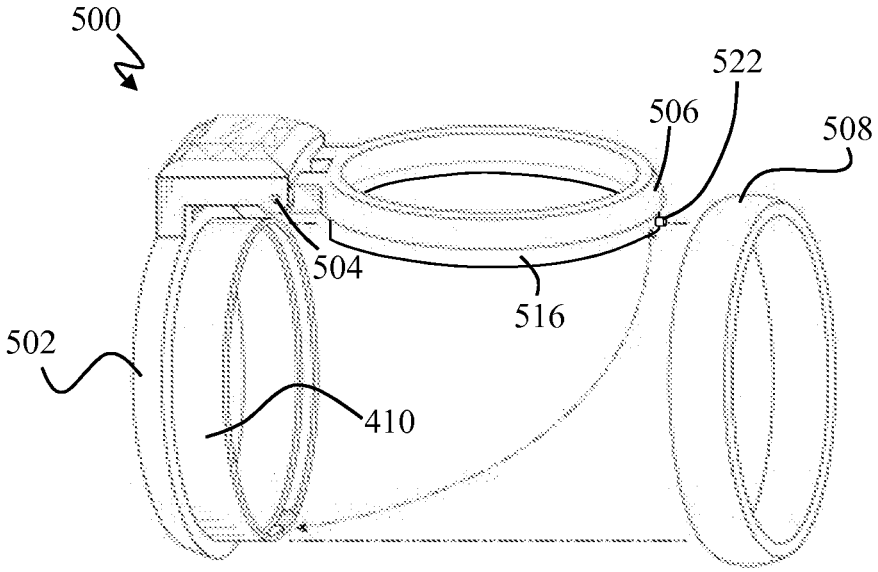
FIG. 5A is a side open exploded view of an exemplary embodiment of an annular element assembly.

FIG. 5A is a side view of an exemplary embodiment of a ring assembly 500, depicting a first peripheral portion 502 and the second hinged peripheral portion 506 rotatably connected at the hinged joint 504 showing a second annular element 508.

Figure 5B:
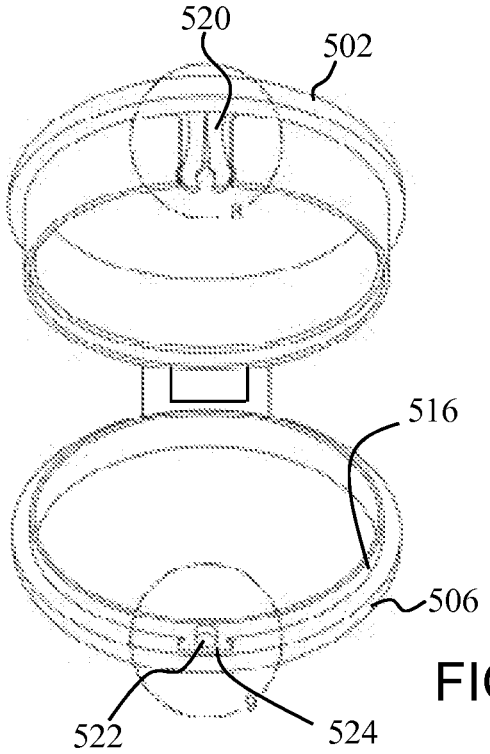
FIG. 5B is a perspective open view, without band, of an exemplary embodiment of an annular element assembly with pin on clasp.

FIG. 5B is a perspective open view, depicting the first hinged peripheral portion 502 and the second hinged peripheral portion 506 rotatably connected at the hinged joint 504 (not shown) and including a pinch clasp 520, highlighted as region 8, and a pin 522 inside an arcuate channel 524 to catch the pinch clasp 520. The pin 522, highlighted as region 9, is attached to a second peripheral channel 516.

Figure 6A:
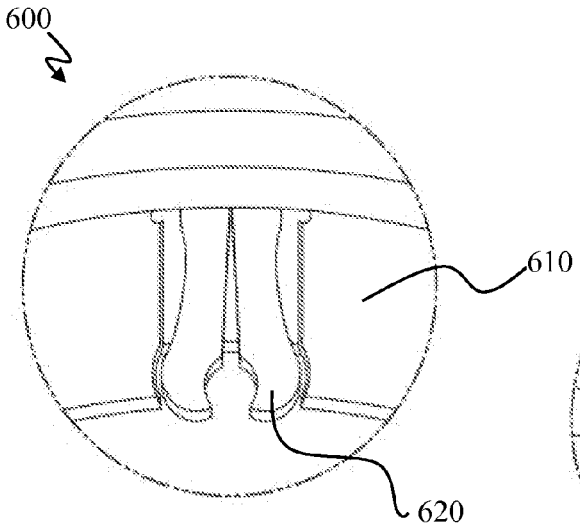
FIG. 6A is a close up view of the pinch clasp of an annular element assembly.

FIG. 6A illustrates a close up view of an exemplary embodiment 600 of the pinch clasp 620.

Figure 6B:
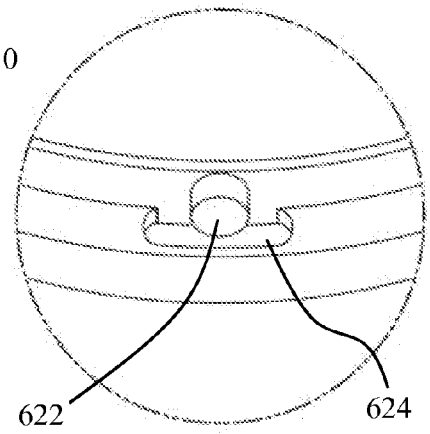
FIG. 6B is a close up of the pin and depression of an exemplary embodiment of an annular element assembly.

FIG. 6B shows a close up of the pin 622 and the arcuate channel 624 which allows the pinch clasp 620 to lock and remain flush with the base of the peripheral channel 610.

Figure 6C:
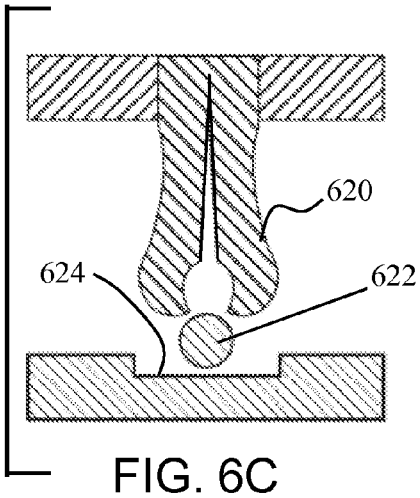
FIG. 6C is a cross-section elevation view, with pin and clasp in relaxed state of an exemplary embodiment of an annular element assembly.

FIG. 6C illustrates a cross-section elevation view, showing the pin 622 and the clasp 620 in relaxed state prior to engaging in the locked position.

Figure 6D:
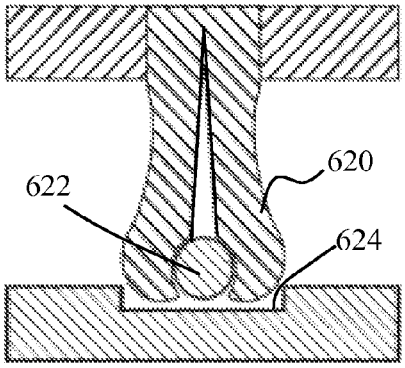
FIG. 6D is a cross-section elevation view, with pin clasp in engaged state, showing pin and depression, of an exemplary embodiment of an annular element assembly.

FIG. 6D illustrates a cross-section elevation view, showing the pin 622 and the clasp 620 in an engaged state.

Figure 7A:
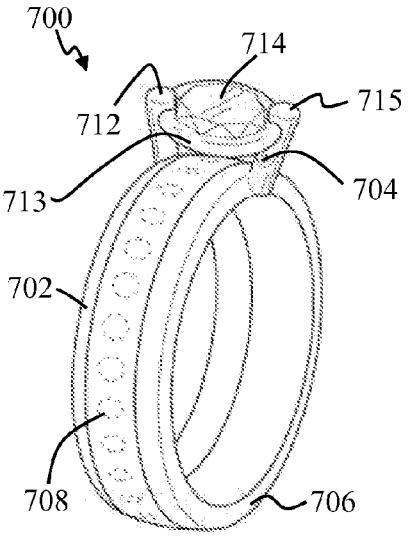
FIG. 7A is a closed perspective view of a second exemplary embodiment of an annular element assembly.

FIG. 7A is a closed perspective view of an exemplary embodiment of an annular element assembly 700. The exemplary annular element assembly 700 comprises an annular first peripheral portion 702, a support structure 712, 715, an ornament 714, a second hinged peripheral portion 706, and a hinge joint 704. The first peripheral portion 702 is depicted as having a support structure 712 with a collar 713 for encasing an ornament 714, where the second hinged peripheral portion 706 is rotatably connected to a support structure 712, 715, via a hinge joint 704.

Figure 7B:
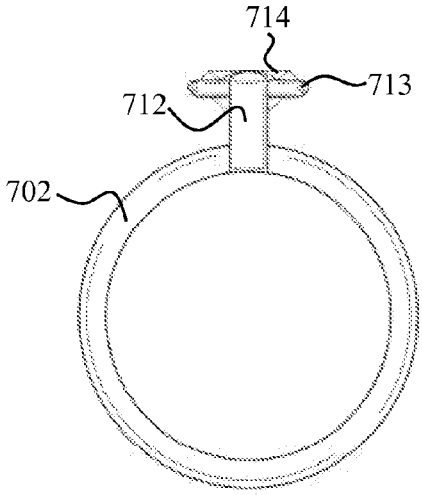
FIG. 7B is a front view of a second exemplary embodiment of an annular element assembly.

FIG. 7B is a front view of an exemplary embodiment of annular element assembly 700.

Figure 7C:
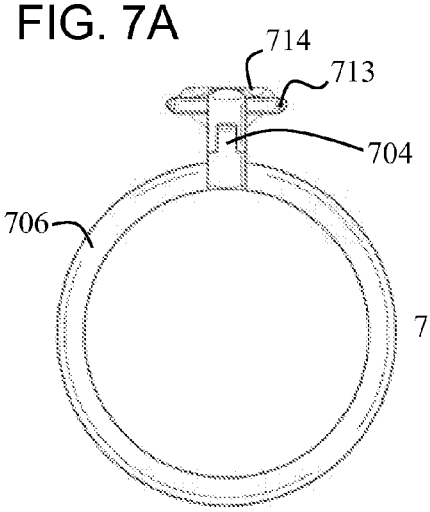
FIG. 7C is a back view of a second exemplary embodiment of an annular element assembly.

FIG. 7C is a back view of an exemplary embodiment of annular element assembly 700.

Figure 7D:
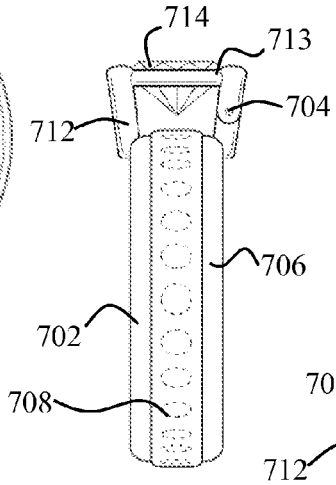
FIG. 7D is a side view of a second exemplary embodiment of an annular element assembly.

FIG. 7D is a side view of an exemplary embodiment of annular element assembly 700. The first hinged peripheral portion 702 is depicted as configured to be hinged at a joint portion 704 to a second hinged peripheral portion 706. The first peripheral portion 702 is depicted has having an annular element 708 having an inner diameter larger than the outer diameter of the base of the peripheral channel (not shown).

Figure 7E:
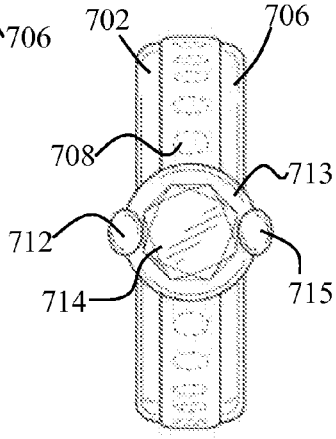
FIG. 7E is a top view of a second exemplary embodiment of an annular element assembly.

FIG. 7E shows a top view of an exemplary embodiment of the invention having a two-pronged support structure 712, 715 for the ornament 714 in this example.

Figure 8A:
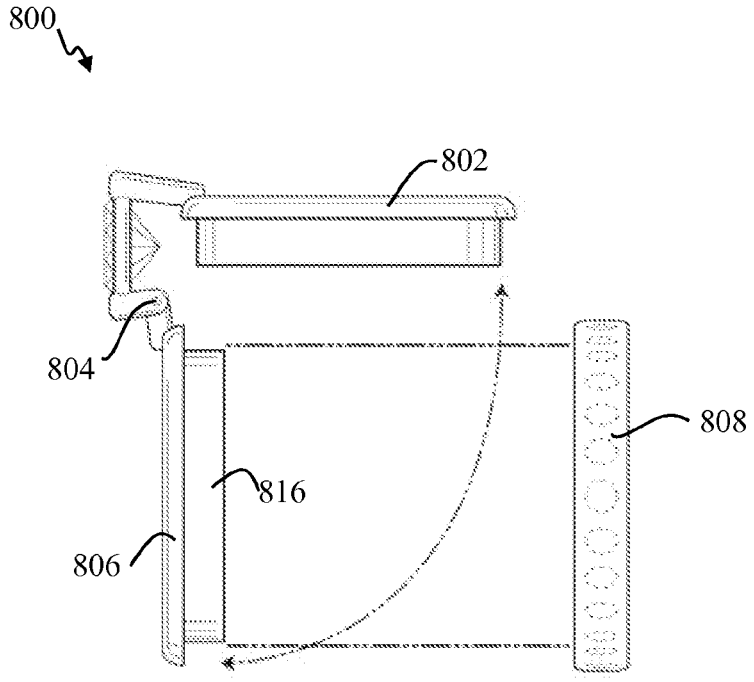
FIG. 8A is a side open exploded view of a second exemplary embodiment of an annular element assembly.

FIG. 8A is a side view of an exemplary embodiment 800 of the opened second peripheral portion depicting a first hinged peripheral portion 802 and a second hinged peripheral portion 806 rotatably connected at the hinged joint 804 showing a second annular element 808 that slips around the base of the peripheral channel 816.

Figure 8B:
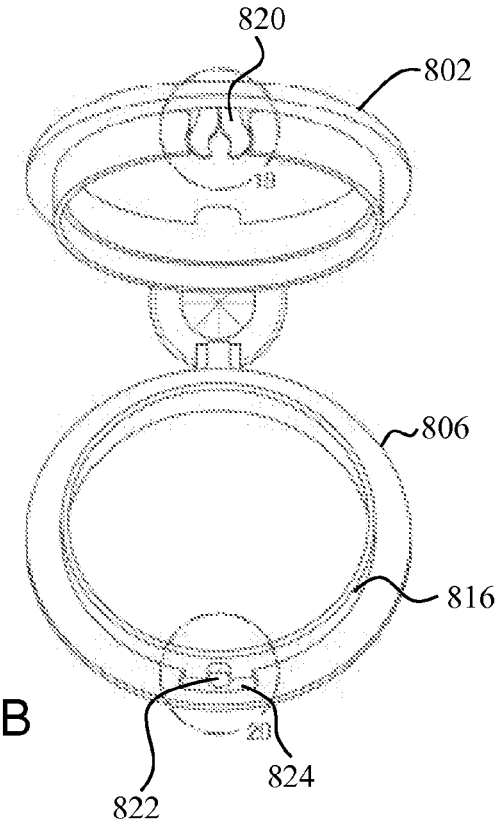
FIG. 8B is a perspective open view, without band, of a second exemplary embodiment of an annular element assembly.

FIG. 8B is a perspective open view, depicting the first hinged peripheral portion 802 and the second hinged peripheral portion 806 rotatably connected at the hinged joint 804 (see FIG. 8A) and including a pinch clasp 820, highlighted as region 19, and a pin 822, highlighted as region 20, inside an arcuate channel 824 to catch the pinch clasp 820.

Figure 9A:
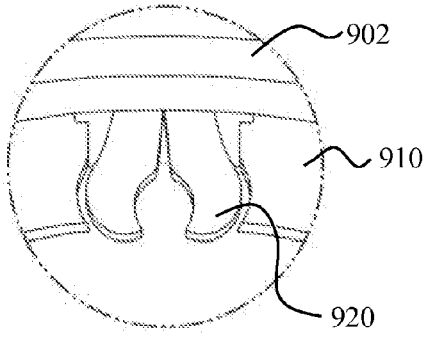
FIG. 9A depicts a pinch clasp of a second exemplary embodiment of an annular element assembly.

FIG. 9A depicts an exemplary close up view of the pinch clasp 920, conformal with the wall 910, the pinch clasp inserted under the wall 902.

Figure 9B:
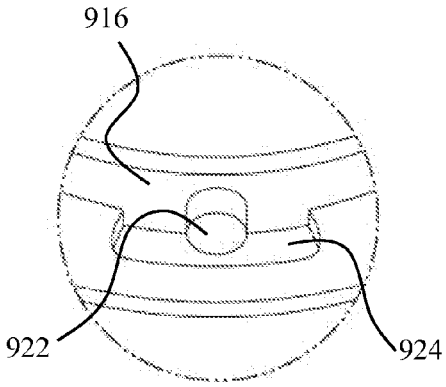
FIG. 9B depicts a pin and depression of a second exemplary embodiment of an annular element assembly.

FIG. 9B shows a close up of the pin 922 and the arcuate channel 924, which allows the pinch clasp 920 (not shown) to lock and remain flush with the inner annular element portion 916.

Figure 9C:
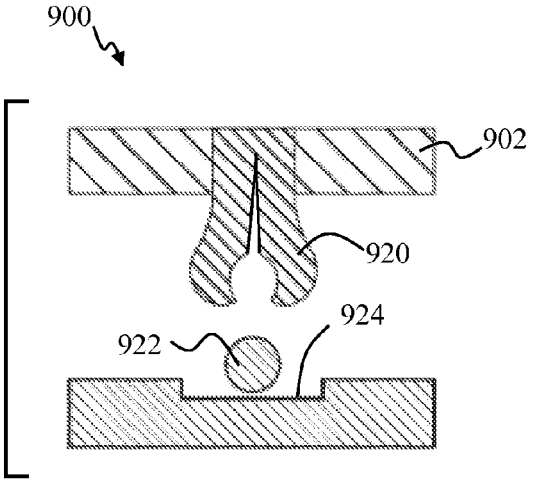
FIG. 9C is a cross-section elevation view, with pin and clasp in relaxed state of a second exemplary embodiment of an annular element assembly.

FIG. 9C illustrates a cross-section elevation view 900, showing the pin 922 and the clasp 920 in a relaxed state prior to engaging in the locked position.

Figure 9D:
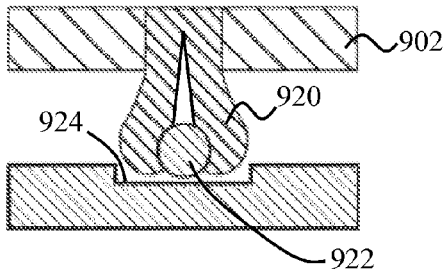
FIG. 9D is a cross-section elevation view, with pin clasp in engaged state, showing pin and depression, of a second exemplary embodiment of the invention.

FIG. 9D illustrates a cross-section elevation view, showing the pin 922 and the clasp 920 in an engaged state.

FIG. 10A is an open perspective view showing an exemplary embodiment of an annular element assembly 1000. The exemplary ring assembly 1000 comprises a first peripheral portion 1002, a second peripheral portion 1006, a pinch clasp 1020, a pin 1022, an annular peripheral channel 1010 and a second annular peripheral channel 1016. The first annular element portion 1002 is depicted as having a curved tangential pinch clasp 1020, and an aperture 1026 to receive a second pin 1023 where the second peripheral portion 1006 is rotatably connected to the first peripheral portion 1002, via the locking mechanism of the pinch clasp 1020, pin 1022, aperture 1026 and a second pin 1023.

FIGS. 10B and 10C illustrate side elevational views. FIG. 10B, showing a front-side, open annular element assembly 1000, the first peripheral portion 1002, a curved tangential pinch clasp 1020, a second peripheral portion 1006 showing a first pin 1022. The annular element assembly 1000 of FIG. 10C also illustrates a back side elevation view showing an open annular element assembly 1000, including an aperture 1026 and a second pin 1023 in an unengaged state.

FIGS. 10D and 10E illustrate side elevational views, showing FIG. 10D as a front-side, open annular element assembly 1000, the first peripheral portion 1002, a curved tangential pinch clasp 1020, a second peripheral portion 1006 showing a first pin 1022. The annular element assembly 1000 of FIG. 10E also illustrates a back side elevation view showing an open annular element assembly 1000, including an aperture 1028 and a second pin 1023 in an unengaged state.

FIGS. 10F and 10G illustrate side elevational views showing FIG. 10F as a front-side, closed annular element assembly 1000, the first peripheral portion 1002 having a curved tangential pinch clasp 1020, a second peripheral portion 1006 showing a first pin 1022. The ring assembly 1000 of FIG. 10G also illustrates a back side elevation view showing a closed annular element assembly 1000, including an aperture 1026 and a second pin 1023 in an unengaged state.

Figure 10H:
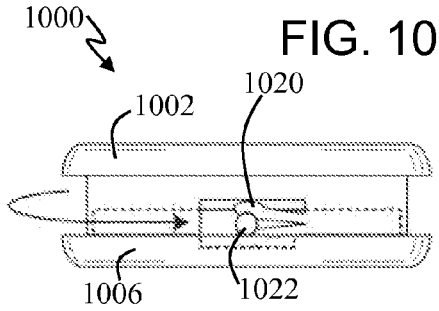
FIG. 10H is a front-side elevation view closed with pin and clasp in an engaged state of a third embodiment of a ring assembly.
Figure 10I:
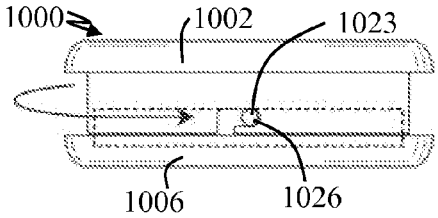
FIG. 10I is a back-side elevation view closed with pin and clasp in an engaged state of a third embodiment of a ring assembly.

FIGS. 10H and 10I illustrate side elevation views, showing 10H as a front-side, closed annular element assembly 1000, the first peripheral portion 1002 having a curved tangential pinch clasp 1020 in an engaged state, a second annular element portion 1006 showing a first pin 1022 in an engaged state. The annular element assembly 1000 of FIG. 10I also illustrates a back side elevation view showing a closed annular element assembly 1000, including an aperture 1026 and a second pin 1023 in an engaged state.

Figure 11A:
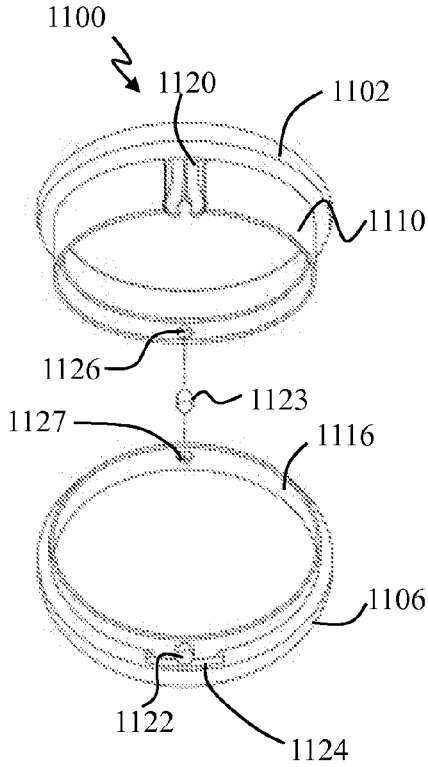
FIG. 11A is an exploded perspective view showing an exemplary pinch/clasp and opposing hole mechanism of a third embodiment of an annular element assembly.

FIG. 11A is an open perspective view of an exemplary embodiment of an annular element assembly 1100. The exemplary annular element assembly 1100 comprises a first peripheral portion 1102, a second peripheral portion 1106, a perpendicular pinch clasp 1120, a first pin 1122, an arcuate channel 1124, an aperture 1126, 1127, a second pin 1123, an annular peripheral channel 1110 and a second annular peripheral channel 1116.

Figure 11B:
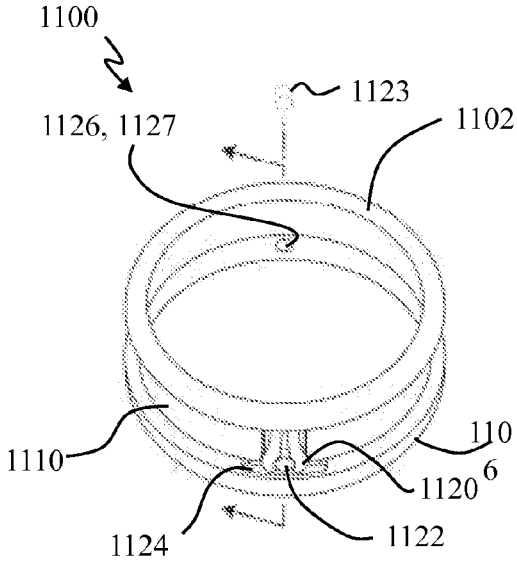
FIG. 11B is a front perspective view, closed, with pinch clasp in engaged state of a third embodiment of an annular element assembly.

FIG. 11B is a closed view of an exemplary annular element assembly 1100, showing an exemplary perpendicular pinch clasp 1120 and the second pin 1123, aligned with apertures 1126, 1127 in an engaged locked state.

Figure 11C:
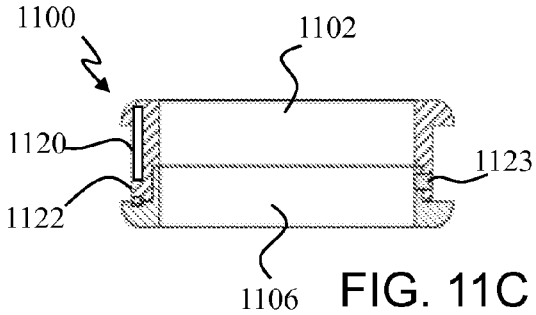
FIG. 11C is a cross-sectional view, closed with pinch/clasp in engaged state and pin engaged in hole of a third embodiment of an annular element assembly.

FIG. 11C is a cross-sectional view of a ring assembly 1100, in a closed position showing a cross-section of the pinch clasp 1120 and a pin 1122 in an engaged state and a cross sectional view of the pin 1123 engaged.

Figure 12A:
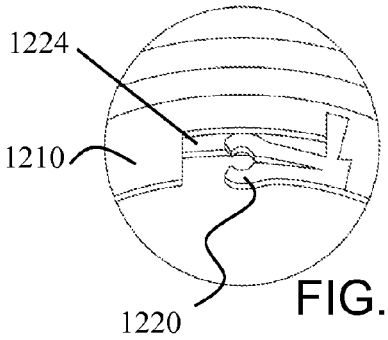
FIG. 12A is a close up view of a fourth embodiment of the pinch clasp of an annular element assembly.

FIG. 12A illustrates a close up view of a non-integral curved tangential pinch clasp 1220 mounted onto the inner peripheral portion 1210 in an arcuate channel 1224 of an embodiment of an annular element assembly.

Figure 12B:
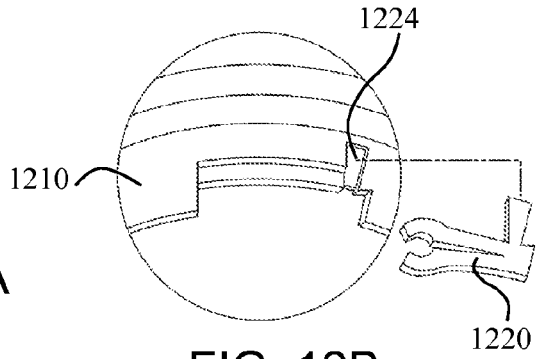
FIG. 12 B is an exemplary non-integral pinch clasp mounted onto a band.
FIG. 12C is an exemplary opposing hole mechanism of a fourth embodiment of an annular element assembly.
FIG. 12D is a perspective view of multiple pinch/clasp blanks showing one clasp removed and exploded out of a fourth exemplary embodiment of an annular element assembly.
FIG. 12E is a perspective view of multiple pinch/clasp blanks showing one clasp removed and exploded out of a fourth exemplary embodiment of an annular element assembly.

FIG. 12B shows an exemplary non-integral curved tangential pinch clasp 1220.

Figure 12C:
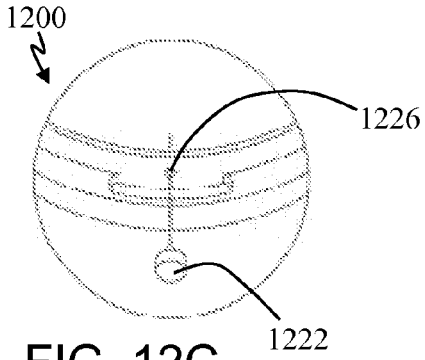

FIG. 12C is an exemplary annular element assembly 1200 comprising an aperture 1226 and a pin 1222.

Figure 12D:
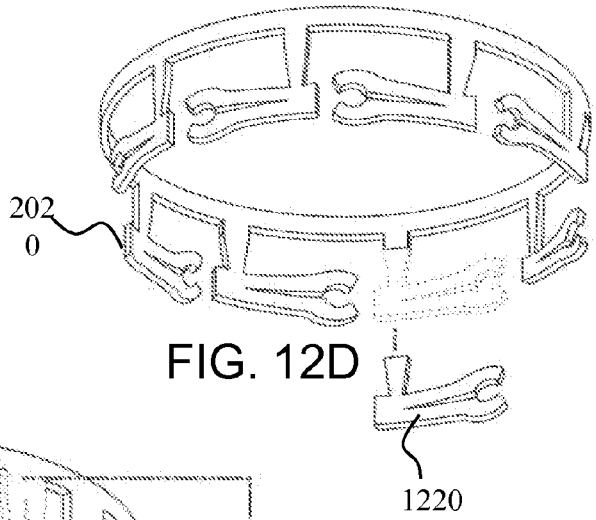

FIG. 12D is a perspective view of multiple curved tangential pinch clasp blanks 2020 showing one clasp 1220 removed and exploded out of an alternate embodiment of a peripheral assembly 2020.

Figure 12E:
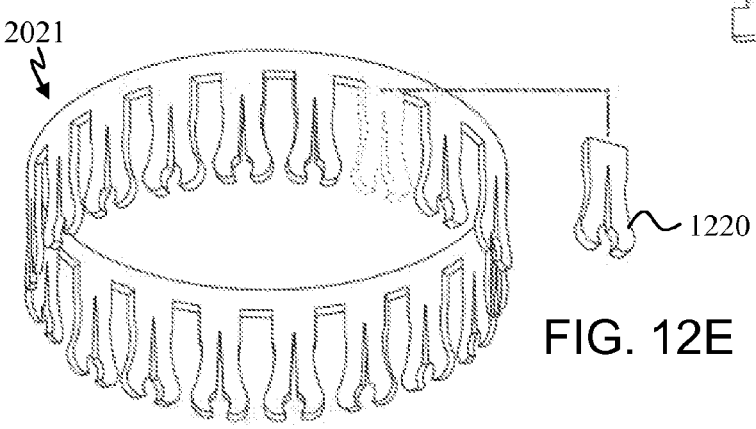

FIG. 12E is a perspective view of multiple perpendicular pinch clasp blanks 2021 showing one clasp 1220 removed and exploded out of an alternate exemplary embodiment of an annular element assembly 2021.

Figure 13A:
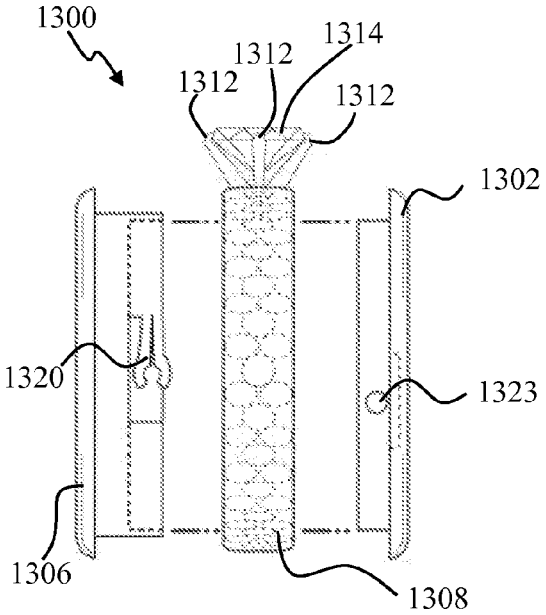
FIG. 13A is an exploded, side view of a fifth exemplary embodiment of an annular element assembly.

FIG. 13A is an exploded, side view of an exemplary embodiment of an annular element assembly 1300. The exemplary annular element assembly 1300 comprises a first annular element portion 1302. The first peripheral portion 1302 is depicted as having a pin 1323 to receive a pinch clasp 1320, where the second peripheral portion 1306 includes a curved tangential pinch clasp 1320, a second annular element 1308, with a support structure 1312 and an ornament 1314.

Figure 13B:
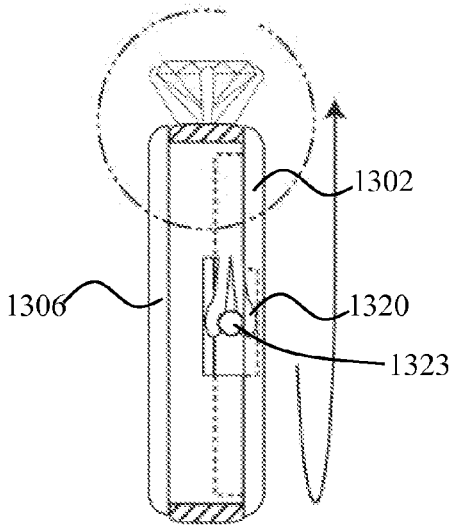
FIG. 13B is a closed side view, without band, of a fifth exemplary embodiment of a ring assembly; and, FIG. 13C is a cross-sectional view of a closed, side view of an exemplary fifth embodiment of a ring assembly.

FIG. 13B illustrates a side elevation view of a closed ring assembly 1300, the first peripheral portion 1302 having a curved tangential pinch clasp 1320 in an engaged state, a second peripheral portion 1306 showing a first pin 1323 in an engaged state.

Figure 13C:
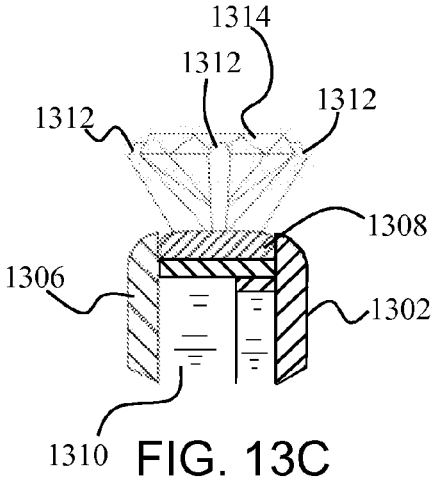

FIG. 13C is a close up, cross-sectional view of a closed, side view of an exemplary embodiment of an annular element assembly 1300 with a support structure 1312, a first peripheral portion 1302, a second peripheral portion 1306, a base peripheral channel 1310, an ornament 1314, and a second annular element 1308.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further it is intended that the scope of the present invention herein disclosed by way of examples should not be limited by the particular disclosed embodiments described above.

What is claimed is:

1. An article of jewelry comprising:

a first annular element;

a second annular element;

an ornament support structure, wherein the ornament support structure is directly attached to the first annular element;

a hinged joint detachably attached to the ornament support structure, wherein the second annular element is attached to the ornament support structure via the hinged joint, and wherein the hinged joint is configured to allow the first annular element and the second annular element to move between an open position and a closed position relative to one another; and a rotatable ring, wherein the rotatable ring is positionable to alternate between a first position interposed between the first annular element and the second annular element when in the closed position and a second position disposed in a distal position separate from the first annular element and the second annular element when the first annular element and the second annular element are in the closed position;

wherein the first annular element comprises a socket portion and wherein the rotatable ring is disposed about the socket portion.

2. The article of jewelry of claim 1 wherein the second annular element comprises a flanged portion, and wherein the flanged portion is configured to engage the socket portion of the first annular element.

3. The article of jewelry of claim 1 wherein the ornament support structure comprises an ornament; wherein the socket portion comprises an inner diameter, an outer diameter, and a width; and wherein the rotatable ring comprises an inner diameter, an outer diameter, and a width.

4. The article of jewelry of claim 3 wherein the outer diameter of the socket portion is smaller than the inner diameter of the rotatable ring.

5. The article of jewelry of claim 4 wherein the width of the rotatable ring is smaller than the width of the socket portion.

6. The article of jewelry of claim 3 wherein the ornament is elevated above the outer diameter of the socket portion of the first annular element.

7. The article of jewelry of claim 3 wherein the ornament is elevated above the outer diameter of the rotatable ring disposed about the socket portion.

8. The article of jewelry of claim 3 wherein the second annular element comprises a flange portion, wherein the inner diameter of the socket portion is the same as the inner diameter of the flange portion, and wherein the outer diameter of the flange portion is smaller than the outer diameter of the socket portion.

9. The article of jewelry of claim 3 further comprising a pin clasp disposed on the first annular element at a position opposite of where the first annular element is directly attached to the ornament support structure.

10. The article of jewelry of claim 9 wherein an outer surface of the pin clasp is flush with the outer diameter of the socket portion.

11. The article of jewelry of claim 9 further comprising a pin disposed on the second annular element at a position opposite of where the second annular element is attached to the ornament support structure via the hinged joint.

12. The article of jewelry of claim 11 wherein the pin is surrounded by an arcuate channel.

13. The article of jewelry of claim 11 wherein the pin clasp disposed on the first annular element is configured to engage the pin disposed on the second annular element in the closed position.

14. The article of jewelry of claim 1 wherein the rotatable ring is laterally constrained by the first annular element when the second annular element is in the closed position.

15. The article of jewelry of claim 14 wherein an ornament in the ornament support structure is elevated above the outer diameter of the rotatable ring wherein the rotatable ring is freely rotatable relative to the socket portion.

* * * * *